US005249959A

United States Patent [19]

Menuge

[11] Patent Number: 5,249,959

[45] Date of Patent: Oct. 5, 1993

[54] DEVICE FOR THE RAPID REPAIR OF A BLAST-FURNACE PLATE

[75] Inventor: Jacques Menuge, Verlincthun, France

[73] Assignee: Terres Refractaires du Boulonnais, Nesles, France

[21] Appl. No.: 781,137

[22] PCT Filed: Jun. 12, 1991

[86] PCT No.: PCT/FR91/00470

§ 371 Date: Dec. 26, 1991

§ 102(e) Date: Dec. 26, 1991

[87] PCT Pub. No.: WO92/01071

PCT Pub. Date: Jan. 23, 1992

[30] Foreign Application Priority Data

Jul. 5, 1990 [FR] France ..... 90 08557

[51] Int. Cl.[5] ..... F27D 1/16

[52] U.S. Cl. ..... 432/76; 432/3; 432/248; 432/99

[58] Field of Search ..... 432/3, 76, 99, 252, 432/248

[56] References Cited

U.S. PATENT DOCUMENTS

| | | | |
|---|---|---|---|
| 4,565,525 | 1/1986 | VanLaar et al. | 432/252 |
| 4,913,649 | 4/1990 | Van der Hoeff | 432/76 |
| 4,960,379 | 10/1990 | Schneider | 432/3 |
| 5,020,992 | 6/1991 | Molenaar et al. | 432/99 |

*Primary Examiner*—Henry C. Yuen

*Attorney, Agent, or Firm*—Pollock, VandeSande & Priddy

[57] ABSTRACT

A device repairs worn depressed surfaces around a tap hole opening in a blast furnace plate. The device includes a preformed frusto-conical member made of a refractory material that is flexible and rapidly baked. A ferrule is formed of frangible material and encloses the refractory member therein. The ferrule is fastened to the nose of a tap hole gun which impacts against the depressed surface thereby causing destruction of the ferrule and allowing adhering deformation of the refractory material to fill the worn depressed surface of the plate—around the tap hole.

3 Claims, 2 Drawing Sheets

DEVICE FOR THE RAPID REPAIR OF A BLAST-FURNACE PLATE

FIELD OF THE INVENTION

The present invention relates to a device permitting rapid repair to be carried out to a worn depressed surface of a blast furnace plate, around the tap hole.

BACKGROUND OF THE INVENTION

It is known that the plate of a blast furnace, also called "headplate," is subject to a high degree of damage at the level of the tap hole. It is thus necessary to ensure the preservation of the area of the refractory which is attacked at the level of the tap hole. The present invention proposes to provide means which make it possible to solve the problem thus posed.

SUMMARY OF THE INVENTION

The subject of the present invention is thus a device permitting a rapid repair of a blast furnace plate to be carried out at the tap hole. On the one hand, the present invention includes a ferrule in consumable material intended to be fastened onto the nose of the tap-hole gun and crushed against the plate of the blast furnace at the tap hole during botting. On the other hand, the present invention includes a piece made from refractory material. This piece is preformed inside the ferrule so as to be deformed against the plate by the tap-hole gun and to be adhered onto the worn depressed surface of the plate around the tap hole, thus forming a protective and relining refractory lining.

According to the invention, the ferrule may optionally comprise notches intended to ensure its fastening onto the nose of the tap-hole gun. These notches preferably have an oblong shape.

According to the present invention, the material forming the refractory piece is a flexible, carbon-containing and rapid-baking material.

Other features and advantages of the present invention will emerge from the description which is set out below with reference to the appended drawings and which illustrate two embodiments thereof, given by way of examples and which have no limiting character.

DETAILED DESCRIPTION OF THE PREFERRED EMBODIMENTS

As has been defined above, the device which is the subject of the present invention is designed so as to provide rapid repair of the plate of a blast furnace at the tap hole. This device essentially comprises two parts.

Figure 1:
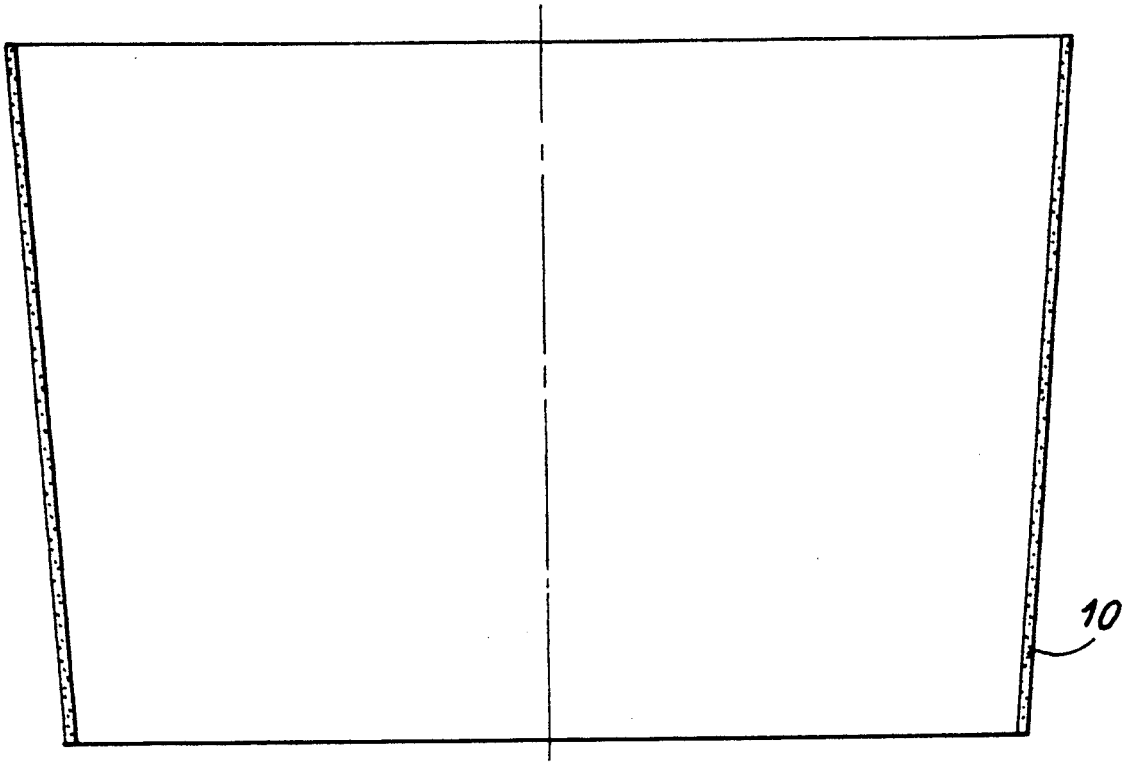
FIG. 1 is a lateral elevational view of a first illustrative embodiment of a ferrule forming part of the device according to the present invention.
Figure 2:
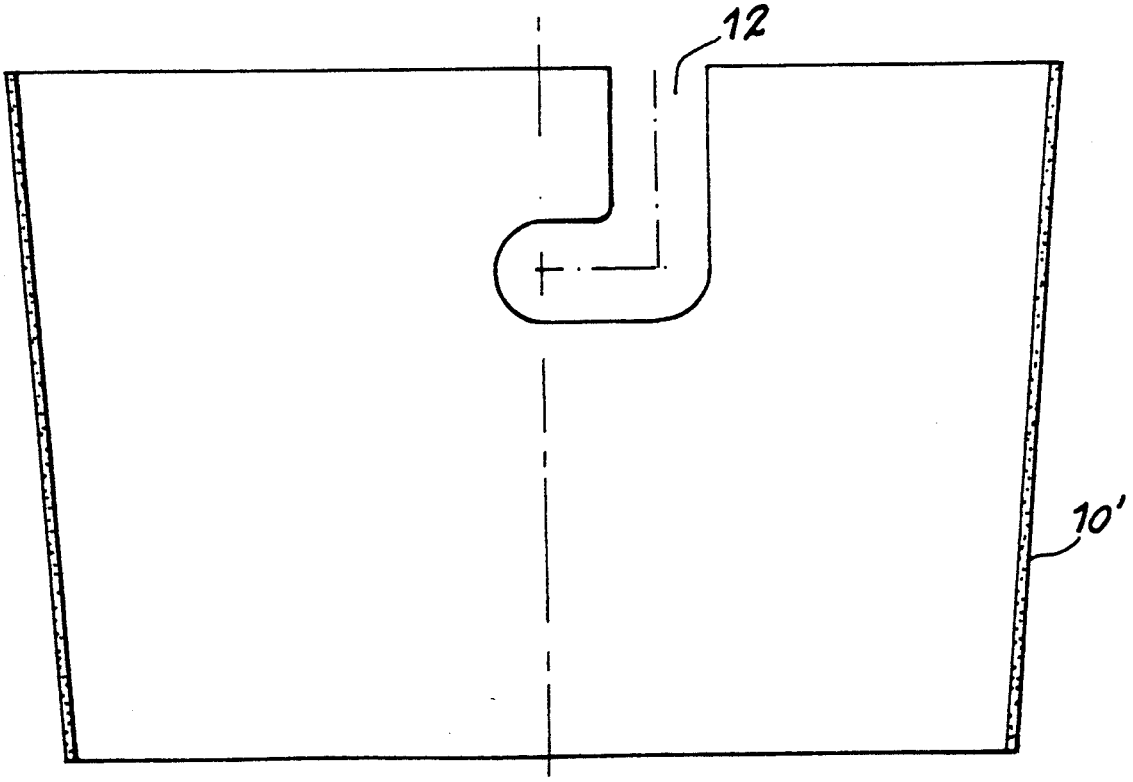
FIG. 2 is a view similar to that in FIG. 1, illustrating a second illustrative embodiment of the ferrule of the device which is the subject of the invention.

On the one hand, the present invention includes a ferrule in consumable material, two illustrative embodiments of which are shown in FIGS. 1 and 2.

Figure 3:
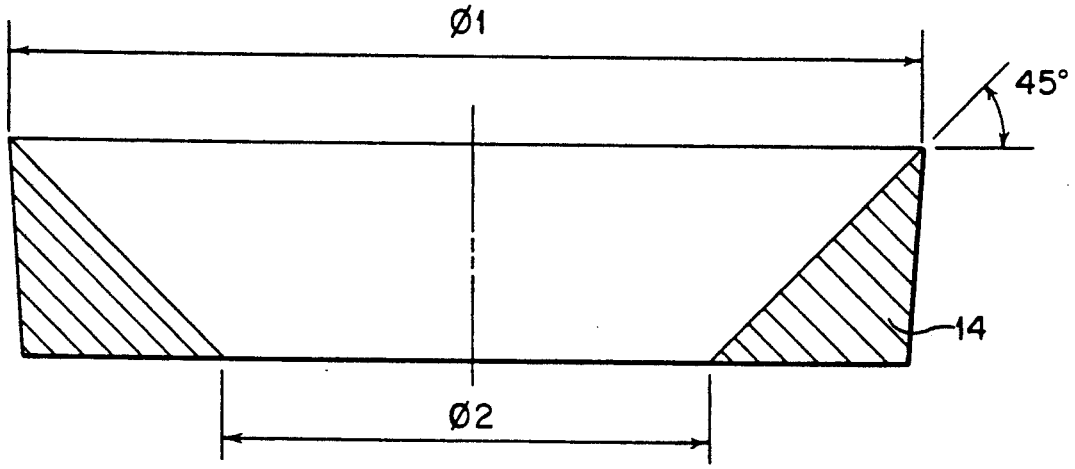
FIG. 3 is a vertical axial sectional view of the refractory material placed in the ferrule of the device according to the invention.

On the other hand, the present invention includes a piece in refractory material positioned in the ferrule and which is shown in FIG. 3.

In the first illustrative embodiment illustrated by FIG. 1, the ferrule 10 is frusto-conical and is designed so as to be crushed and depleted when forced against the plate of the blast furnace at the tap hole during botting. In the second illustrative embodiment shown in FIG. 2, the ferrule 10' has the same characteristics as those of the ferrule 10, but it is provided with notches such as 12, preferably having an oblong shape so as to ensure fastening and blocking of the device on the nose of the tap-hole gun.

Figure 4:
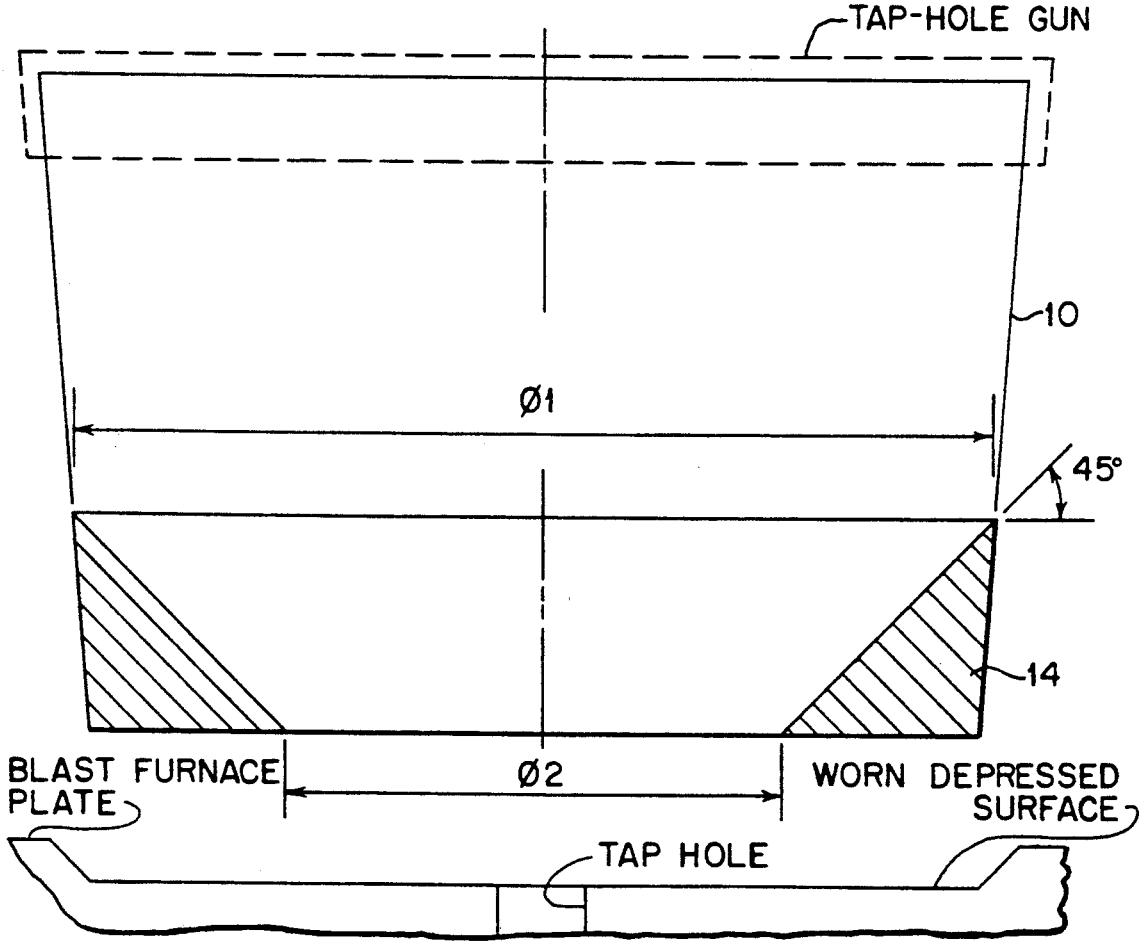
FIG. 4 is a vertical axial sectional view of the device according to the invention, comprising the embodiment of the ferrule illustrated in FIG. 1.

The refractory piece 14, placed in the ferrule 10 or 10', is shown in FIG. 3. It has a frusto-conical outer shape and is equipped with an axial bore in the manner illustrated in FIG. 3. This piece 14 consists of a flexible, carbon-containing, rapid-baking material. It is preformed so that it can be placed inside the ferrule 10 or 10'. To this end, the values of its external diameter $\phi 1$ and its internal diameter $\phi 2$ are determined so that this refractory piece 14 is positioned precisely inside the ferrule, as shown in FIG. 4. The inner walls of the bore of the refractory piece 14 preferably have a slant of 45° relative to the horizontal, as shown in FIG. 3.

As has been specified above, the ferrule 10 or 10' is crushed when forced against the plate by the tap-hole gun. The refractory piece therefore adheres to the worn depressed surface of the blast-furnace plate at the tap hole, forming a protective and relining refractory lining. This lining permits preservation of the area of the blast-furnace refractory which is attacked at the level of the tap hole.

It is, of course, clearly understood that the present invention is not limited to the illustrative embodiments described here, but that it encompasses all variants thereof.

I claim:

1. A device for repairing a worn depressed surface around a tap hole opening in a blast furnace plate, comprising:

a preformed frusto-conical member made of refractory material;

a ferrule formed of frangible material for enclosing the refractory member; and means for fastening the ferrule to the nose of a tap-hole gun;

impact driving by the gun against the depressed surface causing destruction of the ferrule and adhering deformation of the refractory member to fill the worn depressed surface of the plate around the tap hole.

2. The device set forth in claim 1 wherein the refractory member is formed from a flexible, carbon-containing, and rapid baking material.

3. The device as set forth in claim 1 wherein the ferrule has a notch formed therein for mounting the ferrule to the tap-hole gun.

* * * * *